United States Patent [19]

Wright

[11] 4,045,913

[45] Sept. 6, 1977

[54] FIRE RESISTANT, SOUND ATTENUATING, DROP SEAL DOOR

[75] Inventor: John T. Wright, Cattaraugus, N.Y.

[73] Assignee: Champion International Corporation, Stamford, Conn.

[21] Appl. No.: 672,160

[22] Filed: Mar. 31, 1976

Related U.S. Application Data

[63] Continuation of Ser. No. 512,344, Oct. 4, 1974.

[51] Int. Cl.[2] ..... E06B 7/215

[52] U.S. Cl. ..... 49/307; 49/309

[58] Field of Search ..... 49/306–310

[56] References Cited

U.S. PATENT DOCUMENTS

| | | | |
|---|---|---|---|
| 630,216 | 8/1899 | Grover | 49/309 |
| 3,496,676 | 2/1970 | Halpern | 49/307 |

FOREIGN PATENT DOCUMENTS

| | | | |
|---|---|---|---|
| 130,059 | 11/1948 | Australia | 49/309 |

*Primary Examiner*—Kenneth Downey

*Attorney, Agent, or Firm*—Evelyn M. Sommer

[57] ABSTRACT

A fire resistant acoustical panel, partition and door characterized by a unique arrangement of sound blocking material and a novel drop seal mechanism including a plurality of relatively movable, mating wedges disposed in a slot along the bottom of the door.

6 Claims, 8 Drawing Figures

FIRE RESISTANT, SOUND ATTENUATING, DROP SEAL DOOR

This is a continuation of application Ser. No. 512,344, filed Oct. 4, 1974.

A high quality fire resistant structural door element is preferably characterized by a non-continuous arrangement of fire and accoustic resistant materials and by a drop seal mechanism which seats on the floor when the door is closed and which clears the floor when the door is open. The building element of the present invention is similar to those described in U.S. Pat. Nos. 2,593,050, patented Apr. 15, 1952 entitled, "Composite Fire Door", inventors H. W. Paul et al; 3,196,494 issued July 27, 1965 entitled "Fire Resistant Door", inventor S. Hartman et al; and 2,787,345, issued Apr. 2, 1957 entitled "Fire Resistant Structural Units", inventor L. D. Sorbirt et al, which disclosures are incorporated herein by reference. Said patents and the subject application are all assigned to the same assignee.

In the building and construction industry it is very desirable to have a door or panel which is characterized by having high fire and flame resistance, and which also has excellent sound attenuation. Thus many types of construction have been suggested to attain these characteristics without impairing other qualities such as strength, wearability and aesthetic appearance. The panel and door structure of the present invention is characterized by a very high accoustical transmission loss over a wide range of accoustical frequencies.

The present invention may be readily understood by reference to the drawings in which.

Figure 1:
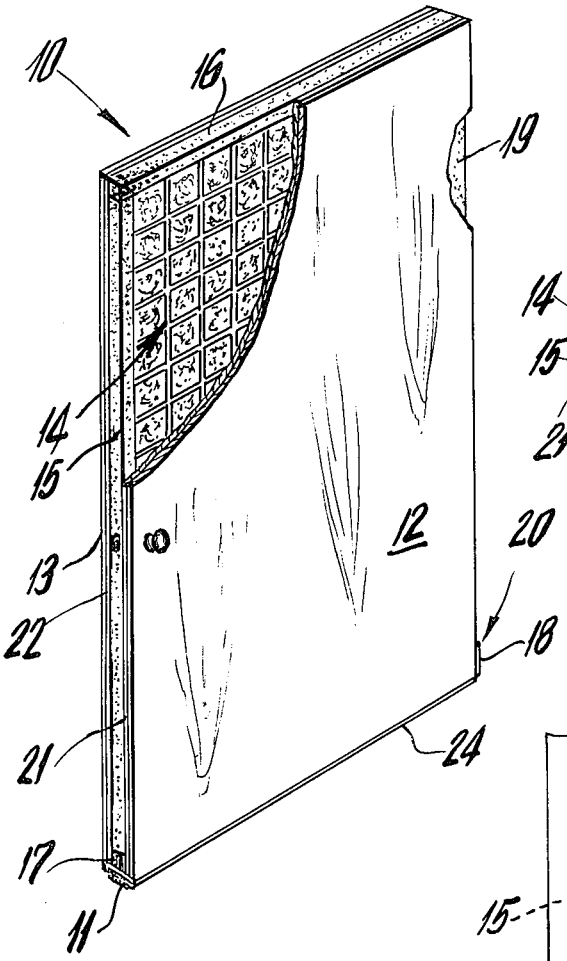
FIG. 1 is a partly broken away perspective view of a door made according to the teachings of the subject invention.
Figure 2:
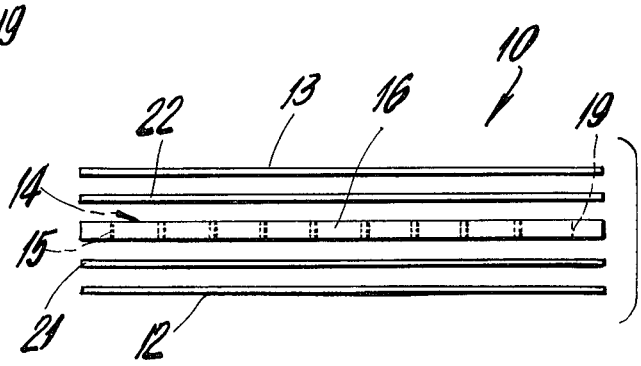
FIG. 2 is an exploded end view of FIG. 1.

Referring particularly to FIGS. 1 and 2 there is shown a door panel consisting of a rectangular frame 10, sheets forming a front face 12 and back or rear face 13, and a core 14 of a grid or waffle type construction. The frame comprises two stiles or side pieces 15 and 19, one of which is visible, and two rails or end pieces 16 and 17. These elements are preferably of a fire resistant material such as cement-asbestos or fire resistant wood such as is commonly known.

The core 14 is a grid or waffle type structure of high acoustical properties and of high flame and fire resistance. In accordance with the present invention the grid is formed with a viscoelastic sound-blocking material having a filler of high density particles. The material is preferably that described in U.S. Pat. 3,424,270 issued Jan. 28, 1969 entitled "Viscoelastic (Sound)-Blocking Material with Filler of High Density Particles", inventors S. Hartman et al, assigned to the present assignee hereof. In essence this material comprises polyvinyl chloride, plasticizer and dense, heavy particles, such as barium sulfate, etc.

Referring to FIG. 2, face plies 12 and 13 may be decorative veneers or plywood while sheets 21 and 22 are of the same fire resistant and sound resistant material mentioned above.

The remaining figures illustrate the unique drop seal mechanism of the present door. Known types of drop seals are expensive and noisy. In addition, they weaken the bottom of the door, and do not correct for non-level or uneven floors. The present device seals the gap between the bottom door rail and the floor, and thus prevents sounds and fire transmission. The drop seal mechanism closes the gap when the door is closed and retracts into the bottom rail 17 of the door when the door is opened. This device allows the door to operate easily over floor coverings such as a carpet and the like.

Figure 3:
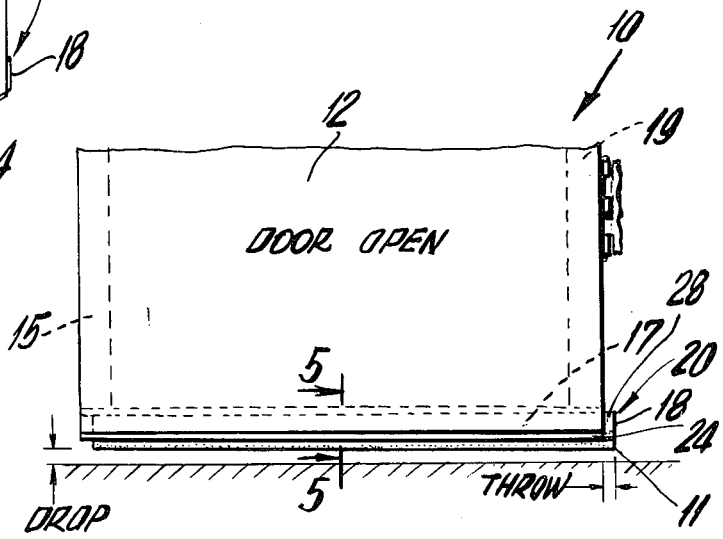
FIGS. 3 and 4 illustrate the drop seal mechanism of the subject invention positioned in the bottom of an open and closed door, respectively.
Figure 4:
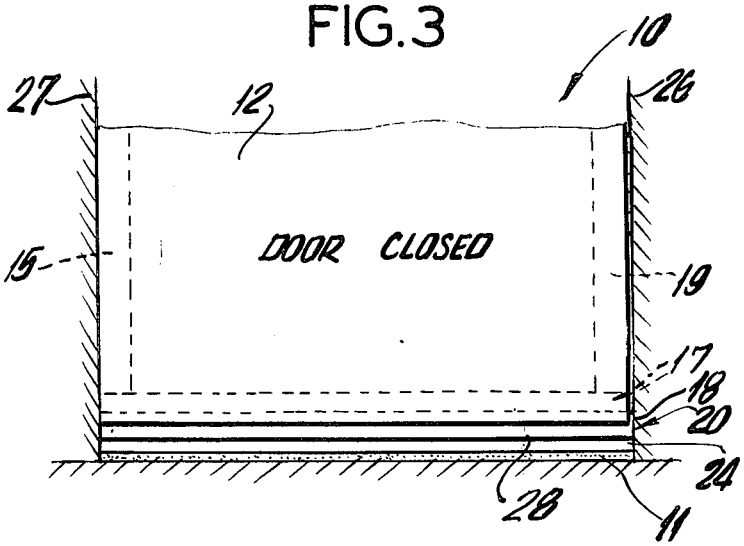

FIGS. 3 and 4 illustrate the drop seal mechanism positioned at the bottom of a door when the door is open and when closed, respectively. The mechanism 20 is positioned in a slot in the bottom rail 17 (not shown) of door 10. The mechanism comprises an activating lever or ear 18 which protrudes beyond the inner stile 19 of door 10, i.e., the hinged side of the door (FIG. 5).

When the door is closed, the lower or movable elements of the mechanism will be moved laterally a distance designated "throw" in FIG. 3, and downwardly a distance designated "drop. " Thus when the door is closed, gasket 11 is supported by a gasket support 24 which is preferably polyvinyl chloride. Preferably barium sulfate or other filler as disclosed in U.S. Pat. No. 3,424,270 in a polyvinyl chloride or similar substance 25 is positioned as shown. The door is supported between bucks or jams 26 and 27, with jam 26 keeping ear 18 in a position when the door is closed against the thrust of a retracting spring or other equivalent means which will be hereinafter described.

Figure 5:
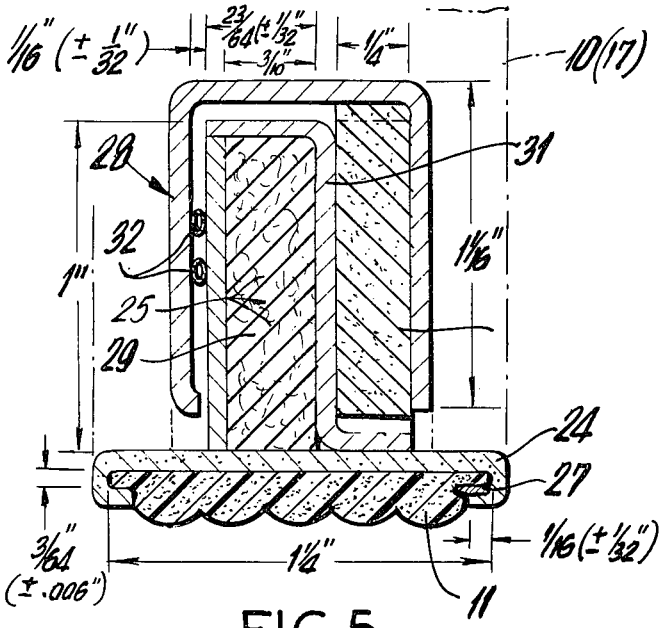
FIG. 5 is a cross sectional view of the drop seal mechanism taken along line 5-5 in FIG. 3.

Referring to FIG. 5 an end view of the mechanism is illustrated with cover 28 seating in a groove in the lower rail 17 and fitting over the operating parts of the mechanism. Typical and satisfactory dimensions for the drop seal are given in FIG. 5. The gasket support will be moved as hereinafter described by an interacting plurality of wedges or parallelograms 30 (see FIG. 6).

The fire resistant and sound attenuation element 29 is shown supported by bracket 31. Ease of movement between cover 28 and the movable elements of the drop seal mechanism is secured by positioning flexible tubing or equivalent means 32 between these respective elements so as to reduce friction.

Figure 6:
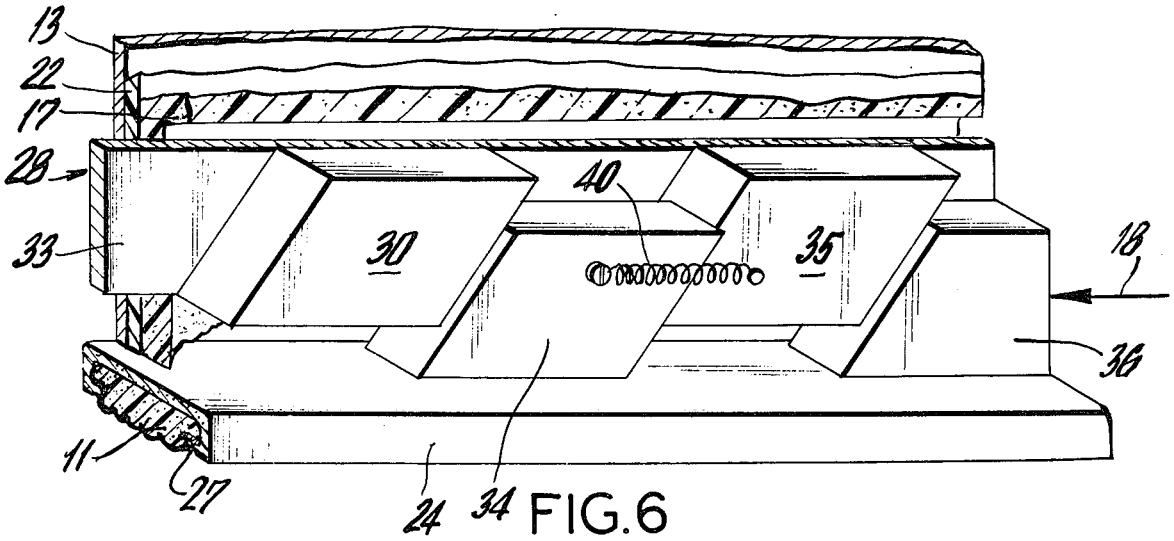
FIG. 6 illustrates in some detail the operation of the drop seal mechanism.

FIG. 6 illustrates in some detail the operation of wedges 30, 34, 35 and 36 (FIG. 5), namely the interaction of the parallelograms. Element 33 comprises one side of cover 28 and this is in stationary relationship with respect to the door. Stationary wedges 30 and 35 are rigidly affixed to element 33. Movable wedges 34 and 36 are rigidly affixed to gasket support 24. It is to be understood that any number of wedges may be utilized and that their precise size and geometric configuration may be varied appreciably depending upon and as a function of other operating factors.

A thurst on ear or lever 18 as hereinbefore described will move gasket holder 24 to the left and downwardly to set the gasket 11 against the floor in a manner to seal off the gap between the lower edge of the door on the floor. A counteracting force exerted by spring or equivalent means 40 will retract the movable elements when the thrust exerted by lever 18 is released due to the opening of the door.

Figure 7:
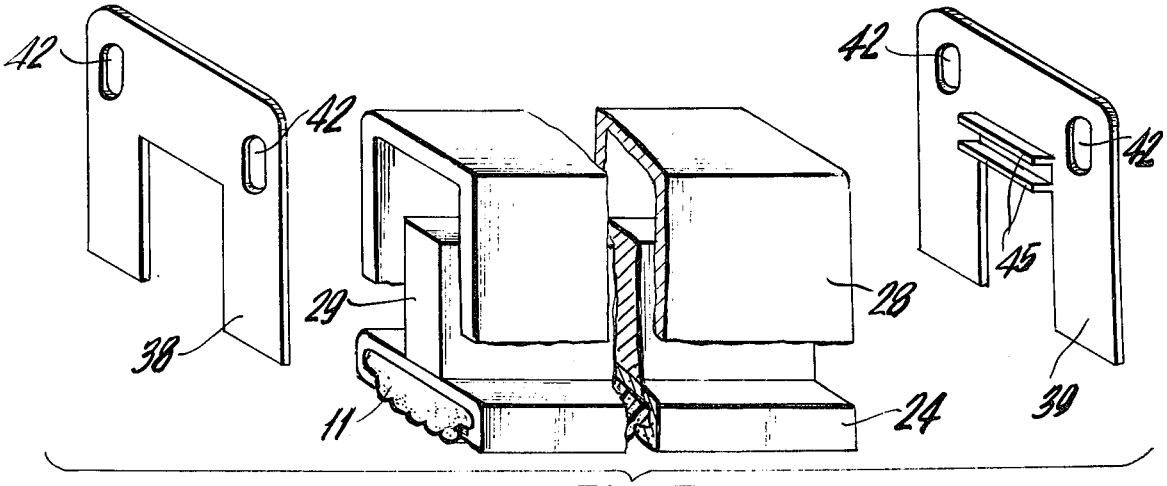
FIG. 7 shows a preferred method of attaching the drop seal mechanism to the door.

A locking plate 27 serves to secure gasket 11 to gasket support 24. A preferred method for attaching the mechanism to the door is shown in FIG. 7. End plates 38 and 39 are securely affixed to cover 28 by lips 45 or screws. These end plates are then affixed flush to the sides of the door by means of screws through holes 42. These holes preferably are elongated to permit adjustment to provide even seating of the drop seal mechanism.

A preferred method of construction is to position a sound attenuation element 29 on gasket support 24 parallel to and abutting the wedge elements 30, 34, and 36 (see FIG. 6). The height of element 29 will approximate the height of wedge elements 34 and 36. A preferred attenuation element is a barium sulfate loaded vinyl filler strip having a thickness of about ⅛ inch to ½ inch. A gasket 11 is securely held by holder 24, and may comprise any suitable material, but is preferably a plastic material such as rigid polyvinyl chloride which is of a high acoustic damping value.

Figure 8:
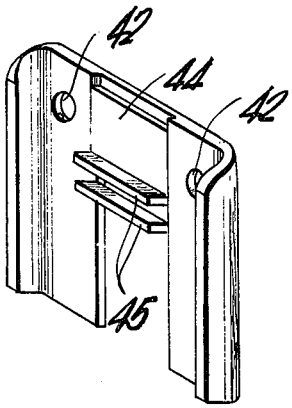
FIG. 8 shows a modified bracket plate for the drop seal mechanism.

FIG. 8 illustrates a modified form of end plate 38. In this modification, circular apertures 42 are provided and adjustment plate 44 and lips 45. This end plate is also provided with lap around sides.

The door structure of the present invention is of such a nature that it will meet the Fire Underwriters Laboratory test described in ASTM E 152-56T Phamphlet U.L. 10 (b) 3rd Edition. For example, one test requires the door to pass the code requirement for a 1 ½ hour fire door test. In this test, the door must be capable of withstanding, for 1 ½ hours, flames which cause a buildup of the temperature to 1790° F. on one face of the door. The temperature rise on the opposite face of the door during the first one-half hour must not exceed 250 ° F. above ambient temperature. At the end of this fire exposure test, the door must withstand the impact of a water hose stream at 30 lbs. pressure, which water hose stream is sprayed on the door from a distance of 20 feet for one minute and 47 seconds. As pointed out heretofore, the door or structure of the present invention is highly resistant to the leakage or transmission of high temperature heat which might ignite any flammable materials which are located on the cold side of the structure.

Core 14 of the door contains fireproof and non-burning inorganic materials which have excellent heat insulating properties. A particularly desirable material for the core is "Weldrok" which is sold by Champion International Corporation. In essence, the core materials of Weldrok consist essentially of an incombustible mineral material of complex metal silicates with asbestos fiber binder. Density of the core material ranges from about 18 to 24 lbs/ft$^3$. Weight/sq. ft. is about 4 lbs. Weldrok is warp free and stable and possesses a U factor of approximately 0.35 B.T.U./hr/sq. ft./° F. A desirable density is in the range of 20 to 24 lbs./cu.ft. and a particularly preferred type of material for the core is calcium silicate subhydrate which is rendered porous by manufacturing steps.

The high quality of the door of the present invention is illustrated by the following example.

EXAMPLE

A drop seal door of the type described was tested for transmission loss in db at various frequencies (250 to 4000 c.p.s.). In test A, the door was constructed employing a drop seal without the sound attenuation element 29. In test B, the sound attenuation element 29 (see FIG. 5) was added to the door structure, with the element 29 comprising a barium loaded vinyl element of approximately ½ inch thickness. The average transmission loss factors over the frequency range of 250–4000 cycles per second for each test was as follows:

| TEST | TRANSMISSION LOSS (Decibels) |
|---|---|
| A | 37.8 |
| B | 47.8 |

Hence the addition of the sound attenuating strip 29 increased the efficiency of the door by approximately 27% which is a dramatic improvement in the characteristics of the door.

Thus the door of the present invention has both high fire and flame resistance, as well as excellent sound attenuation characteristics. The drop seal mechanism can be made of any suitable material, but is preferably a solid polyvinyl chloride such as one loaded with barium sulfate or other heavy density compound. As illustrated in FIG. 7, it is very desirable to have a strip of a nonflammable material extend along the area of the wedges 30. This material is preferably a polyvinyl chloride compound containing about 5% to 100% by weight of high density particles such as barium sulfate. This strip greatly increases acoustic damping, and seals out fire, noise and even radiation.

The "drop" and "throw" of the mechanism (FIG. 3) may be adjusted by the changing adjustment of the angles of the wedges (FIG. 6). Generally the ratio of drop and throw should not exceed about 3:1, and is preferably about 2:1. Also the throw which is the distance that the door buck pushes the drop seal in the direction of the door should be at least about ⅛ inch and preferably about ¼ inch. This will fill the opposite corner when the door is closed and will be flush behind the face of the door stile when it is opened.

The geometric configurations of the wedges or parallelograms illustrated in FIG. 6 may be widely varied depending upon other functional elements. Their function is that when a thrust is exerted on ear 18, elements 34 and 36 will move downwardly. Conventional means are preferably employed to reduce the friction between the sliding surfaces, such as the use of a lubricant or the use of ball bearing mechanisms on the sliding surfaces of 30, 34, 35 and 36. Element 40 for example could be a mechanism which is compressed upon the thrust of 18 and expands when the thrust is abated.

The embodiments of the invention, in which an exclusive property or privilege is claimed, are defined as follows:

1. A solid, fire resistant sound attenuating, drop seal door which comprises in combination:

a. a solid, sound attenuating door, having an elongated slot, wholly embedded in the bottom rail thereof;

b. an elongated generally U-shaped cover to fit snugly within said slot;

c. an elongated gasket support movably positioned within said cover;

d. an extension secured to the gasket support and extending beyond the inner stile of the door;

e. a plurality of parallelogram shaped wedges disposed in two series positioned within said cover, a first series of wedges having wedge elements spaced apart and rigidly affixed to said cover, a second series of wedges having wedge elements alternately spaced between the elements of the first series and rigidly affixed to said gasket support, all of said wedge elements formed with confronting plane cam faces in a manner that when the extension is moved in a horizontal direction by contact with the inner door jamb, the second series of wedge elements and gasket support will move downwardly with respect to said first series of wedge elements and the rectangular cover; and f. a horizontally disposed tension means coupled between the first and second series of wedge elements for raising the gasket support when the door is opened;

said confronting cam faces being so disposed that the cam faces at one end of said wedge elements serve to cam the gasket support downwardly against the bias of the horizontally disposed tension means, and the cam faces on the opposite ends of said wedge elements serve to cam the gasket support upwardly under the influence of the horizontally disposed tension means.

2. A drop seal door as defined by claim 1 wherein said wedges have a geometric configuration of solid parallelograms including acute and obtuse angles.

3. A drop seal door as defined by claim 1 wherein a sound attenuating strip is positioned on said gasket support adjoining the second series of wedge elements.

4. A drop seal door as defined by claim 3 wherein said sound attenuating strip comprises a barium sulfate filled polyvinyl chloride strip.

5. A drop seal door as defined in claim 1 wherein said gasket supports a pliable gasket of polyvinyl chloride positioned in a plane parallel to the plane of a floor under the door.

6. A drop seal door as defined in claim 1 wherein said horizontally disposed tension means is a helical spring.

* * * * *